US006889439B2

(12) United States Patent
Koukal et al.

(10) Patent No.: US 6,889,439 B2
(45) Date of Patent: May 10, 2005

(54) BATTERY-POWERED MANUAL MACHINE TOOL

(75) Inventors: Oliver Koukal, Stuttgart (DE); Klaus Baumgaertner, Sindelfingen (DE); Klaus Schoen, Altbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/432,294

(22) PCT Filed: Sep. 4, 2002

(86) PCT No.: PCT/DE02/03263

§ 371 (c)(1),
(2), (4) Date: May 21, 2003

(87) PCT Pub. No.: WO03/047818

PCT Pub. Date: Jun. 12, 2003

(65) Prior Publication Data

US 2004/0045176 A1 Mar. 11, 2004

(30) Foreign Application Priority Data

Nov. 30, 2001 (DE) ..... 101 59 050

(51) Int. Cl.[7] ..... B27B 9/04

(52) U.S. Cl. ..... 30/377; 30/388; 30/391; 30/124

(58) Field of Search ..... 30/377, 390, 505, 30/388, 389, 391, 277.4, 292, 228, 216, 500, 393, 124, 516, 353, 392, 502; 408/199, 241, 124; 83/835, 820

(56) References Cited

U.S. PATENT DOCUMENTS

| | | | | | |
|---|---|---|---|---|---|
| 3,353,573 | A | * | 11/1967 | Hitzeroth | 30/125 |
| 4,589,208 | A | * | 5/1986 | Iwasaki et al. | 30/376 |
| 4,876,797 | A | * | 10/1989 | Zapata | 30/388 |
| 4,983,080 | A | | 1/1991 | Somers et al. | |
| 5,121,803 | A | | 6/1992 | Hartmann et al. | |
| 5,755,293 | A | * | 5/1998 | Bourke | 173/29 |
| 5,902,080 | A | | 5/1999 | Kopras | |
| 5,964,039 | A | * | 10/1999 | Mizoguchi et al. | 30/392 |
| 6,161,293 | A | * | 12/2000 | Watson | 30/377 |
| 6,189,217 | B1 | * | 2/2001 | Melvin et al. | 30/125 |
| 6,641,467 | B1 | * | 11/2003 | Robson et al. | 451/334 |
| 6,739,224 | B1 | * | 5/2004 | Wershe | 81/437 |
| 2002/0054798 | A1 | * | 5/2002 | Dils et al. | 408/124 |

FOREIGN PATENT DOCUMENTS

GB 1 432 409 A 4/1992

* cited by examiner

*Primary Examiner*—Allan N. Shoap
*Assistant Examiner*—Ghassem Alie
(74) *Attorney, Agent, or Firm*—Michael J. Striker

(57) ABSTRACT

A battery-operated hand power tool (10), in particular a power saw (101), having a housing (12) into which a battery pack (28) can be detachably inserted in captive fashion, and between the battery pack (28) and the housing (12), an elongated auxiliary tool (38) is stored, in particular for releasing the tool, preferably the saw blade, is made more secure and convenient to manipulate by disposing the auxiliary tool (38) in such a way that it is visible from outside and is easy to feel, and in particular can be reached through.

6 Claims, 3 Drawing Sheets

BATTERY-POWERED MANUAL MACHINE TOOL

PRIOR ART

Figure 1:
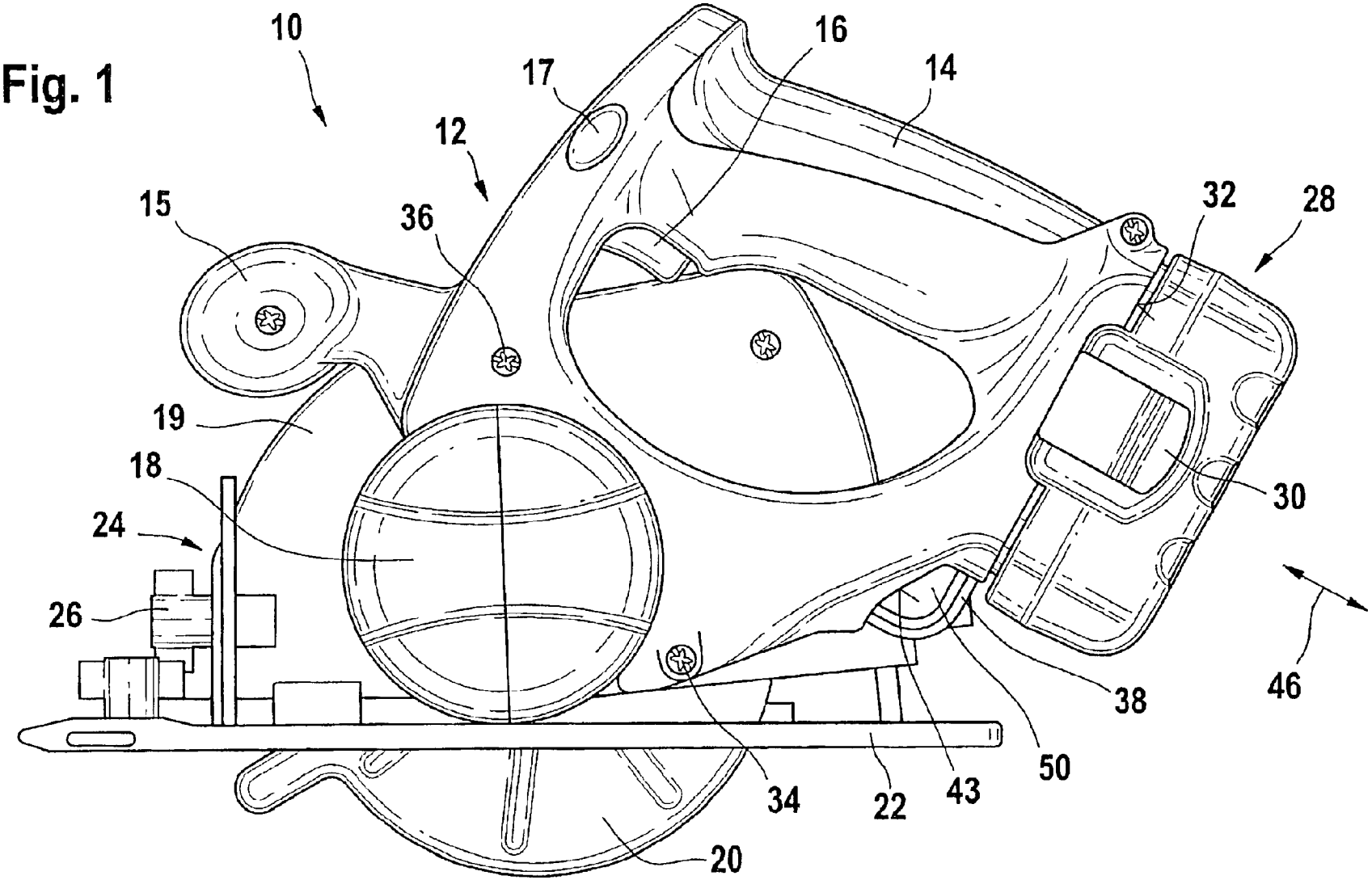

The present invention is based on a battery-operated hand power tool as generically defined by the preamble to claim 1.

Battery-operated hand power tools are already known in which an elongated auxiliary tool is accommodated invisibly from outside between the housing and the releasable battery pack and can be removed only after the battery pack has been removed.

The auxiliary tool serves to release and secure the tool of the battery-operated hand power tool, such as the saw blade of a hand saw. Because of the aforementioned accommodation of the auxiliary tool between the battery pack and the housing, it is assured that changing the saw blade can be done only when the battery pack has been released. This prevents the saw blade from moving while it is being changed and prevents injury to the user if the switch is inadvertently touched.

Since the auxiliary tool is concealed invisibly between the battery pack and the housing, it is harder to find. In the worst case, the user forgets where the auxiliary tool is accommodated and, without removing the battery, uses some other auxiliary tool that fits, thus running the risk of injury already described.

ADVANTAGES OF THE INVENTION

The invention having the characteristics of claim 1 has the advantage that the auxiliary tool is secured in captive fashion in an exposed place on the battery-operated hand power tool, yet is accommodated clearly visibly and is available especially fast, as it were blind.

Because the auxiliary tool is embodied in angular form, and both ends are supported in the housing and a middle region, especially the angular region, protrudes from the housing, the auxiliary tool forms a protrusion that can be felt and grasped especially well.

Because the angular region of the auxiliary tool protrudes so far past the outer contour of the housing that it can be reached through, it can be removed especially simply, after removal of the battery pack, by hooking the finger through it. Moreover, because of this arrangement, the auxiliary tool forms an eyelet by which it can be hung up, stored, and transported.

Because the outer contour of the housing forms a recess in the region of the protruding auxiliary tool, at least a finger can conveniently reach through the auxiliary tool and remove it especially simply.

Because the auxiliary tool has two legs, in particular one longer leg and one shorter leg, and one leg can be inserted parallel to the battery insertion direction into a hole in the housing that is concealed by the battery pack, and the other leg can be placed in a groove in the housing, next to the battery pack, the auxiliary tool is stowed in a way protected against vibration, and the risk of rattling noises during work with the battery-operated hand power tool is precluded.

Because the auxiliary tool can be removed only with the battery pack released and is locked in captive fashion on the hand power tool by the inserted battery pack, the auxiliary tool cannot be removed when the battery pack is activated, which assures the safety of the user on changing tools and minimizes the risk of injury.

DRAWING

The present invention will be described in terms of an exemplary embodiment in conjunction with the drawing.

Shown are

Figure 2:
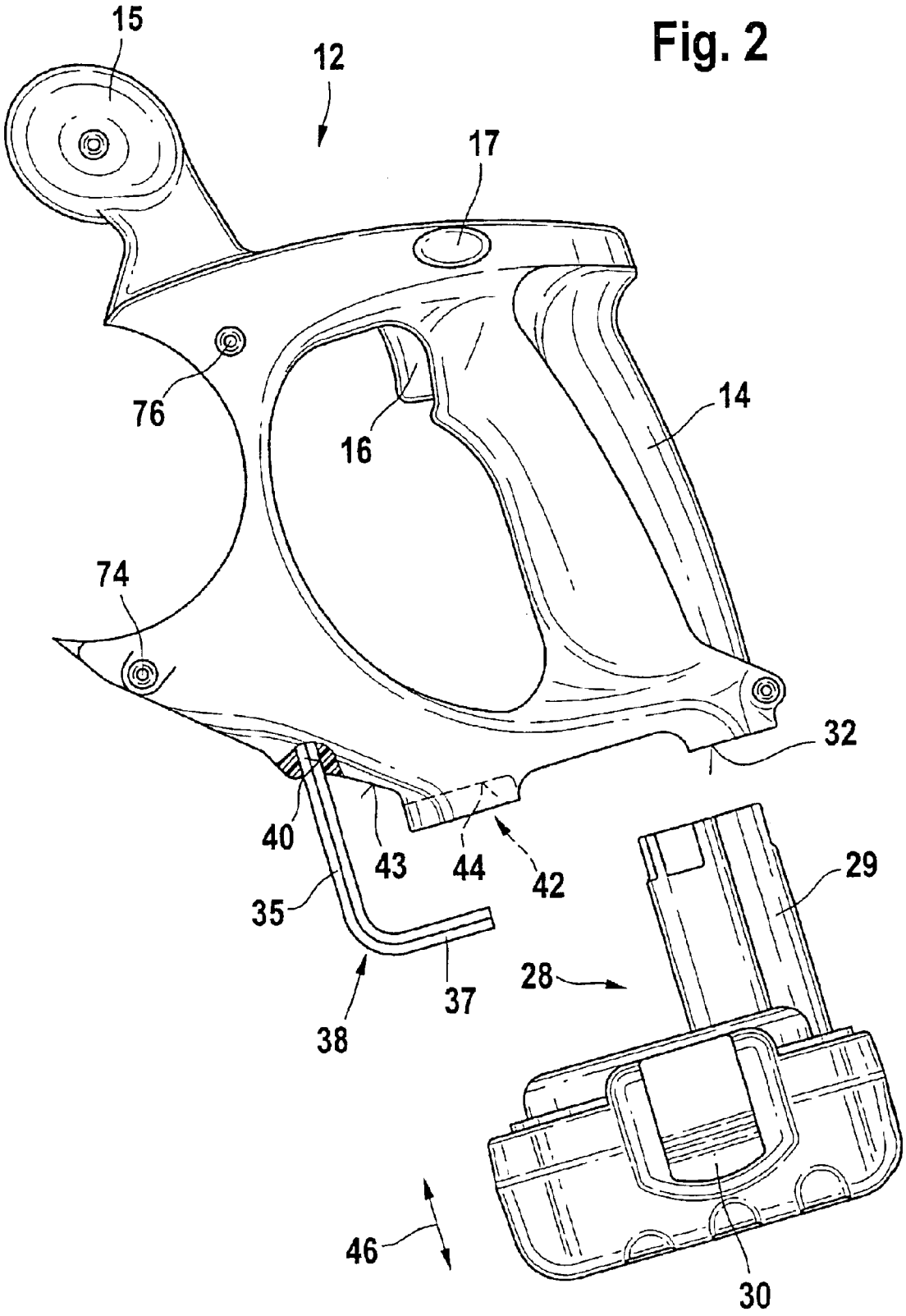
Figure 3:
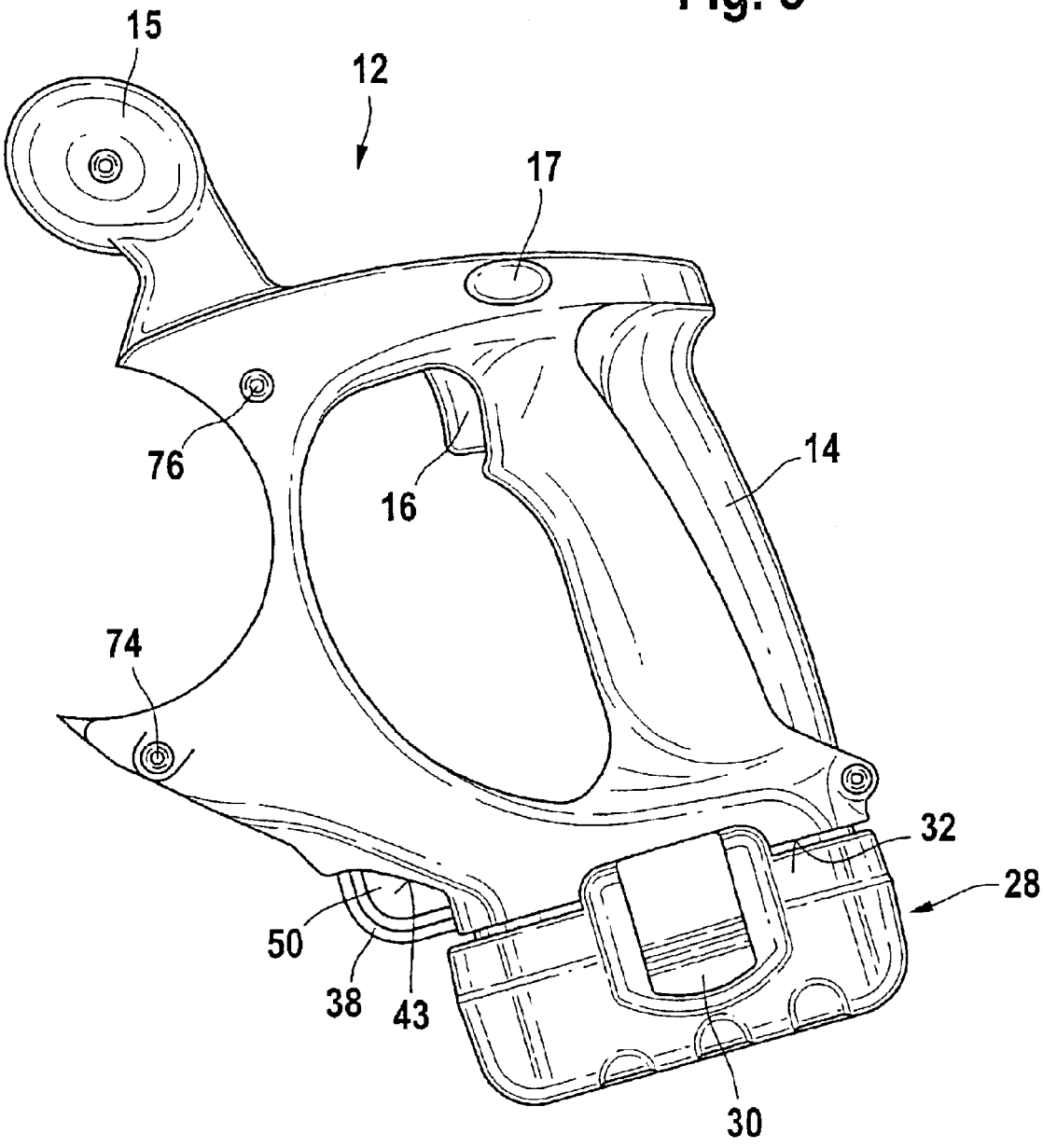

FIG. 1, a side view of the hand power tool with the auxiliary tool;

FIG. 2, a hand grip part of the hand power tool with the battery pack and the auxiliary tool, in an exploded view; and FIG. 3, the same view as FIG. 2, reassembled.

EXEMPLARY EMBODIMENTS

FIG. 1 shows a side view of a hand power tool 10, embodied as a circular saw, and its housing 12, with one hand grip 14 for the hand holding the tool and one guiding hand grip 15 for the guiding hand of the user.

The main hand grip 14 has a switch 16 for switching the drive motor, not shown, on and off. A locking button 17 that can be pressed in from the side to lock the switch 16 in the ON mode is disposed above the switch 16.

A saw blade housing 19 is flanged laterally to the housing 12 and has a motor housing 18, which extends out of the plane of the drawing in the viewing direction.

At the bottom, the saw blade housing 19 has a swing guard hood 20, which extends protectively around the circular saw blade, not shown.

The housing 12 and the saw blade housing 19 are coupled with a base plate and are supported on it pivotably and with an adjustable height by means of a link 24.

By means of a locking screw 26, the link 24 can be locked, so that arbitrary pivoting positions of the housing 12, 18 relative to the base plate 22 can be locked.

A battery pack 28 protrudes from the housing 12 to the right and downward in the viewing direction, parallel to the extension of the main hand grip 14. The battery pack has lateral release buttons 30, which when pressed in allow the battery pack 28 to be released or removed, in the direction of motion indicated by the arrow 46, from the housing 12, parallel to the main hand grip 14. An auxiliary tool 38, embodied as a wrench for hexagonal-socket screws, extends in the extension of the lower edge 32 of the housing 12, protruding angularly outward from the contour of the housing 12 and defining a reach-through opening 50.

With one long leg 35, the auxiliary tool 38 fits, parallel to the insertion direction of the battery pack 28, into a tight-fit resilient insertion opening 40 into the interior of the housing 12, and with its short leg 37, it can be placed in an insertion groove 42, parallel to the lower edge of the housing 12, flush as far as the groove bottom 44.

FIG. 2 shows the housing 12 of the hand power tool 10 without the motor housing 18 and without the saw blade housing 19, in an exploded view, showing the battery pack 28 and the auxiliary tool 38.

A contact cylinder 29 of the battery pack 28 can be seen clearly; with it, the battery pack 28 is thrust deeply—in the direction of motion indicated by the arrow 46—into the interior of the hand grip 14 or of the housing 12.

The auxiliary tool 38, also known as an Allen wrench, is thrust with its long leg into the insertion opening 40 and can be thrust inward until the shorter leg 37 meets the groove bottom 44. Only then can the battery pack 28 be secured in snap-in fashion to the housing 12.

Removing the battery pack 28 takes place in reverse order from the process of inserting it. Only after the battery pack

28 has been removed from the housing 12 is removal of the auxiliary tool 38 possible at all or convenient. This is accomplished by reaching through the opening 50, which is formed by the recess 43 of the housing 12 and formed by a concavely curved housing contour, with the angular region of the auxiliary tool 38.

The housing 12 has lateral screw openings 74, 76, through which screws 34, 36 can be inserted, with which the saw blade housing 19 can be screwed in flangelike fashion to the side of the housing 12.

Accordingly, the auxiliary tool 38 can be removed from the housing 12 only after the battery pack 28 is removed. A hexagonal-socket screw (not shown) for securing the saw blade (also not shown) to the motor shaft can then be turned with the auxiliary tool 38 both in the release direction and in the fastening direction. This assures that the electric motor of the battery-operated hand power tool will not be set into motion if the switch 16 is mistakenly touched, and thus prevents injury to the user form a rotating saw blade while he is changing the saw blade.

What is claimed is:

1. A battery-operated hand power tool (10) in the form of a power saw (10) having a saw blade, comprising, housing (12), wherein a battery pack (28) can be detachably inserted into the housing in captive fashion, and wherein between the battery pack (28) and the housing (12), an elongated auxiliary tool (38) is stored for releasing the saw blade, wherein the auxiliary tool (38) is disposed such that it is visible from outside and is easy to feel and can be reached through, wherein the auxiliary tool (38) is removable only when the battery pack (28) has been released completely from the housing (12).

2. The hand power tool of claim 1, wherein the auxiliary tool (38) is designed in angular form in an L-shape and both ends (35, 37) are supported in the housing (12) such that the ends are not visible from outside, and a middle region, protrudes from the housing (12).

3. The hand power tool of claim 1, wherein the angular region of the auxiliary tool (38) protrudes outward past an outer contour of the housing (12).

4. The hand power tool of claim 1, wherein an outer contour of the housing (12) forms a recess (43), wherein said recess can be reached through by at least one finger.

5. The hand power tool of claim 1, wherein the auxiliary tool (38) has two legs (35, 37) in the form of one longer leg and one shorter leg, and wherein one leg can be inserted parallel to the battery insertion direction into a hole in the housing (12) that is concealed by the battery pack (28), an the other leg can be placed in a groove (42) in the housing (12) next to the battery pack (28).

6. A battery-operated hand power tool (10) in the form of a power saw (10) having a saw blade, comprising, a housing (12), wherein a battery pack (28) can be detachably inserted into the housing in captive fashion, and wherein between the battery pack (28) and the housing (12), an elongated auxiliary tool (38) is stored for releasing the saw blade, wherein the auxiliary tool (38) is disposed such that it is visible from outside and is easy to feel and can be reached through, wherein the auxiliary tool (38) is fixed and nonreleasably locked to the housing (12) by insertion of the battery pack (28).

* * * * *